US005121864A

United States Patent [19]

Geschwind

[11] Patent Number: 5,121,864

[45] Date of Patent: Jun. 16, 1992

[54] PICKPOCKET FOILING POUCH

[76] Inventor: Howard N. Geschwind, 5135 Choc Cliff Dr., Bonita, Calif. 92002

[21] Appl. No.: 571,199

[22] Filed: Oct. 5, 1990

[51] Int. Cl.[5] ..... B65D 37/00; A45C 1/04

[52] U.S. Cl. ..... 224/230; 224/236; 224/229

[58] Field of Search ..... 224/236, 230, 229, 237, 224/246, 231, 235, 191; 150/134, 133, 141, 142, 144

[56] References Cited

U.S. PATENT DOCUMENTS

| | | | |
|---|---|---|---|
| 122,942 | 1/1872 | Fritsche | 224/230 X |
| 1,404,278 | 1/1922 | Davis | 150/134 |
| 1,886,218 | 6/1931 | Noel | 224/230 |
| 2,092,222 | 9/1937 | Myres | 224/231 |
| 2,508,755 | 7/1948 | Galen | 224/230 |
| 2,586,584 | 2/1952 | Wagner | 150/134 |
| 3,032,088 | 5/1962 | Stonebraker | 150/134 |
| 4,119,249 | 10/1978 | Hanson | 224/236 |
| 4,744,477 | 5/1988 | O'Neal | 224/229 |
| 4,825,922 | 5/1989 | Rolfs | 150/134 |

*Primary Examiner*—Henry J. Recla
*Assistant Examiner*—David J. Walczak

[57] ABSTRACT

A pouch slips into the back pocket of trousers or into the inside pocket of a coat. Subsequently, when a wallet is inserted into the pouch and the pouch flap folded over to form a closed envelope, the wallet may not easily be removed from the pouch, and the pouch is too large to be easily removed from the pocket, so that pickpockets are effectively foiled.

3 Claims, 1 Drawing Sheet

PICKPOCKET FOILING POUCH

BACKGROUND OF THE INVENTION

Pocket picking is an old art that is still avidly practiced in many parts of the world. As is a known fact, skilled pickpockets can pick a wallet out of a back pocket, even unbuttoning the back pocket, and sometimes out of a coat pocket, without the owner even being aware that physical contact has been made.

There are a number of ploys that are used to separate the mark from his wallet. For example, a team of two may work the revolving door of a department store or hotel. As the mark is on his way to the revolving door, the first member of the team begins walking in front of him, with the second member picking up the pace right behind the mark. Just as the first member of the team enters the door, he stops short as though he decided not to exit, causing the three bodies to collide together. The second team member separates the wallet from the mark during the impact, subsequent to which the team members are embarrassed and polite about the incident, and everyone goes their separate ways.

Because of ploys of this nature, and other techniques in which the mark is jostled unknowingly by pickpockets, it is difficult for a traveler to safeguard his wallet in conventional clothing. A rear trouser pocket having an enclosing flap and a button is no substantial deterrent for a skilled pickpocket team.

For this reason, money belts have been developed, and although somewhat awkward to use, do provide one of the best means of safeguarding against pickpockets. With a money belt, one is safe from all but muggers, inasmuch as it is inconceivable that even with a jostling ploy a pickpocket could get inside the money belt, unzip it, and extract folding money. However, the money belt is limited in that it is not a convenient place to store credit cards and the other things that are generally carried in a wallet. Money belts are not convenient places for cash. And even if the cash is all in the money belt, that does the traveler relatively little good if all of his identification and credit cards are stolen by a pickpocket not realizing there is no cash in the wallet.

There is a need, therefore, for some foiling device which would effectively retain the wallet in the pocket despite the efforts of eve the most skilled pickpocket or team of pickpockets.

SUMMARY OF THE INVENTION

The instant invention fulfills the above-stated need and comprises a simple pouch which is inserted into pocket before the wallet is inserted into the pouch. The pouch itself is slightly wider, than the mouth of the pocket. Once the pouch is inserted in the pocket, and a wallet is inserted in the pouch, the combination pouch and wallet cannot be removed by normal force.

To prevent the wallet from being slipped out of the pouch, it has a folding flap which passes over the top and preferably joins to itself with hook-and-loop fastener material (Velcro TM ) inside the pocket, making it virtually impossible to either open the flap, or remove the pouch, without such inordinant jostling of the intended victim that the pickpocket's intentions would be readily apparent.

DETAILED DESCRIPTION OF THE PREFERRED EMBODIMENTS

The pouch of the instant invention is indicated at 10. It is defined from a rear panel 12 and a front panel 14 which are sewn together at !6 around the sides and bottom to define a body portion 18. The body portion defines an interior cavity 20. In the preferred embodiment, both the front and rear panel, are made of cloth, with the front panel preferably being made of a stiffer cloth than the rear panel so that it does not collapse when the wallet is being inserted into the pouch when it is contained in the pocket.

Figure 3:
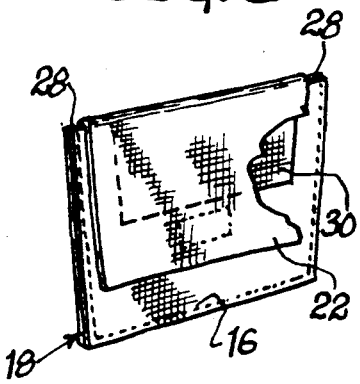
FIG. 3 illustrates the pouch in its closed mode with the flap folded over.
Figure 4:
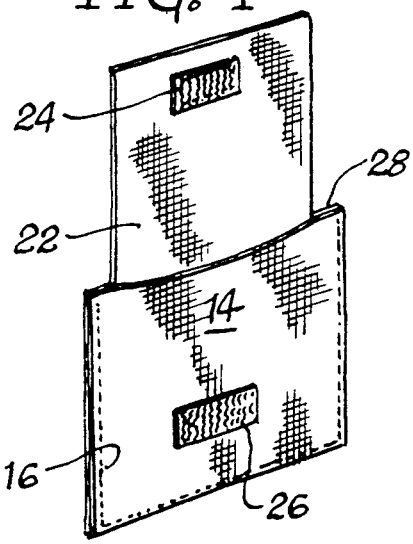
FIG. 4 is an elevation view of a modification of the invention.
Figure 5:
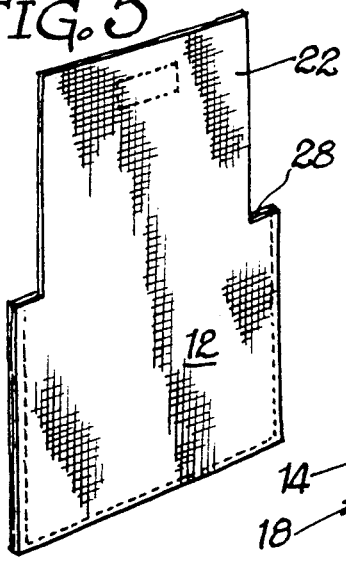
FIG. 5 is a rear elevation view of the modification illustrated in FIG. 4.
Figure 6:
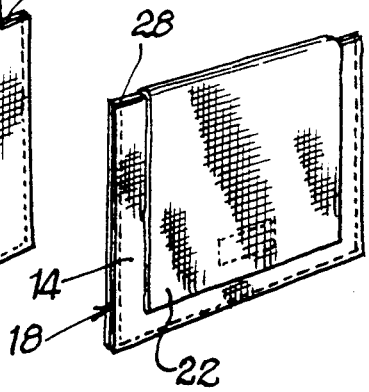
FIG. 6 is a perspective view of the modified embodiment shown in FIGS. 4 and 5 with the flap pulled over.

The rear panel has an extending flap 22, which can be an extension of the same cloth that forms the panel. The flap contains a Velcro TM patch 24 which mates with the Velcro TM patch 26 on the front panel so that the pouch can be closed like a wallet as shown in FIG. 3.

The body portion 18 of the pouch is slightly wider at the shoulder area 28 than the mouth of a pocket into which the pouch is inserted. The shoulder 28 of the body portion tends to engage in the edges of the pocket and prevent its easy removal. The flap 22 on the other hand is somewhat narrower, and when the pouch is in a pocket ready to receive a wallet, it is in the configuration illustrated in FIG. 1, with the flap's side away from the body, and the front panel 14 toward the body.

In the preferred embodiment, the upper shoulder region of the pouch is wider than the width across the bottom of the pouch. This slight taper makes the pouch less noticeable in the pocket and makes the pouch easier to insert.

Figure 1:
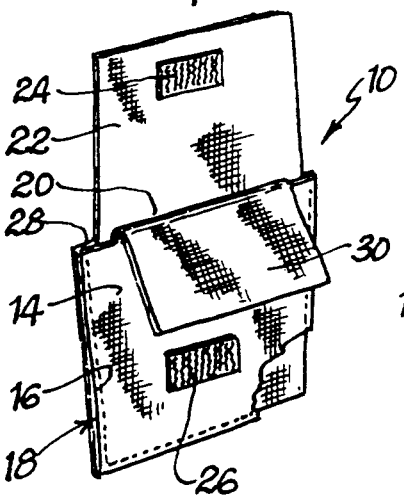
FIG. 1 is a perspective view of the first embodiment of the invention.

The front panel preferably has a tab 30, shown best in FIG. 1. This tab is engaged by the fingers of the user when the wallet is inserted in the cavity to prevent the front panel 14 from collapsing inside the pocket. This tab could also be made integrally with the front panel 14, in the same fashion as the flap 22 is integral with the rear panel 12.

Figure 2:
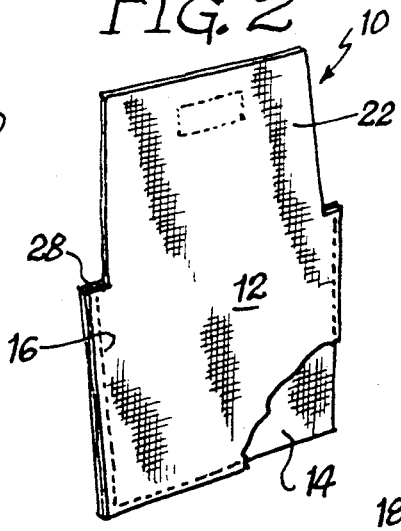
FIG. 2 is a perspective view of the rear of the pouch.
Figure 7:
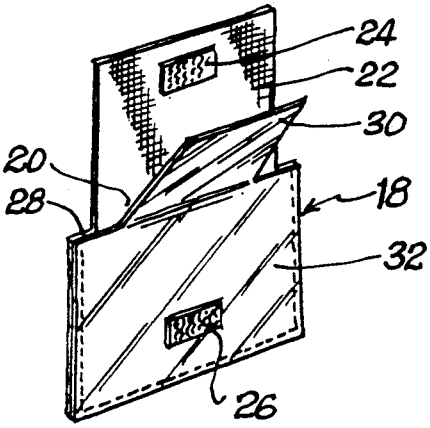
FIG. 7 is yet a third modification or embodiment in which the front panel has a plastic, and preferably transparent plastic, lower portion; and, FIG. 8 illustrates the pouch with a wallet contained therein.

It would also be possible to make the front panel of a non-fabric material such as plastic or leather. An embodiment illustrating this is shown in FIG. 7. The plastic is indicted at 32, and comprises a sheet of either transparent or opaque material to which is sewn or glued or otherwise bonded the tab 30, or the front panel and the tab could be a continuous, unitary piece. Other than the fact that the front panel 32 is plastic, the construction is identical with that of the embodiments shown in FIGS. 1 through 3.

In use, the pouch inserts in the pocket and assumes the configuration shown in FIG. 1. An open mouth is provided for the cavity 20. It is not terribly difficult to insert the pouch in the pocket at this point because the wallet is not inside.

Once the pouch is in the pocket, the wallet is inserted into the cavity, while holding up the front tab 30 in those embodiments having a front tab. Then, the tab and the longer flap 22 are folded over as shown in FIGS. 3 and 8, encapsulating the wallet 34 inside the pouch.

Figure 8:
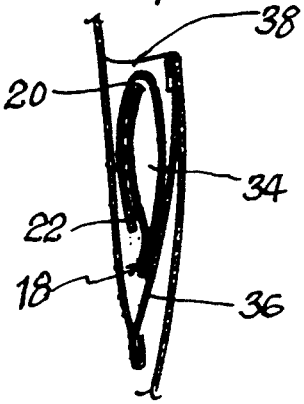

As shown in FIG. 8, now the pouch and wallet are securely inside the pants pocket 36. The pouch is wider in the shoulder area 28 than the mouth 38 of the pocket, and is really quite difficult to remove. Because the pocket itself, and the Velcro TM, holds down the flap 22 of the pouch, the pouch cannot be easily opened without disturbing the pocket and its owner, and it certainly would be extremely difficult to remove the pouch with the wallet contained therein.

Thus, the thief is assuredly thwarted, and yet with only a little additional effort the wallet is accessible to its rightful owner.

It would be very difficult even for a skilled pickpocket, knowing of the pouch, to develop a technique for .its removal or removal of the wallet. However, this would no doubt not be done, inasmuch as unfortunately the pickpocket would simply move on to an easier mark. In any event, the person carrying the pouch would be secure from any conceivable pocketpicking effort.

It is hereby claimed:

1. A pouch for insertion in a pocket for holding a wallet, said pouch comprising;

(a) a front panel;

(b) a rear panel fastened to said front panel around at least portions of side and bottom edges thereof to define a body portion having a front and an open-topped cavity to receive a wallet or the like;

(c) said body portion being at least as wide as a mouth of said pocket;

(d) a flexible flap extending up from said body to pass around the open-topped cavity and front thereof to define a closed envelope to enclose a wallet or the like;

(e) said flap having a Velcro TM patch on said front panel;

(f) said flap comprising an upward extension of said rear panel;

(g) said panels being made of fabric and said front panel being made of a stiffer fabric than said rear panel to hold its shape in a pocket as the wallet is inserted into the pouch in a pocket; and, (h) said front panel defining a tab extending above said body to provide gripping means for the user.

2. Structure according to claim 1 wherein said rear panel and flap are unitary and said front flap and tab are unitary.

3. A method of foiling a pickpocket to prevent theft of a wallet from a pocket comprising the following steps:

(a) inserting a pouch larger than the mouth of said pocket into said pocket;

(b) inserting said wallet in said pouch; and, (c) said pouch having an upwardly extending flap, and including step (c) of folding said flap over the top of said pouch after step (b).

* * * * *